United States Patent [19]

Razin et al.

[11] 4,396,841

[45] Aug. 2, 1983

[54] DEVICE FOR SCANNING A BEAM OF CHARGED PARTICLES

[76] Inventors: Gennady I. Razin, prospekt Kirovsky, 44/16, kv. 18; Dmitry S. Valtman, poselok Metallostroi, ulitsa Pushkinskaya, 5, kv. 48, both of Leningrad, U.S.S.R.

[21] Appl. No.: 276,375

[22] PCT Filed: Oct. 18, 1979

[86] PCT No.: PCT/SU79/00098

§ 371 Date: Jun. 16, 1981

§ 102(e) Date: Jun. 16, 1981

[87] PCT Pub. No.: WO81/01228

PCT Pub. Date: Apr. 30, 1981

[51] Int. Cl.[3] ..... H01J 3/26

[52] U.S. Cl. ..... 250/396 R; 315/17

[58] Field of Search ..... 315/17; 313/361; 250/396 R, 396 ML, 310, 311

[56] References Cited

U.S. PATENT DOCUMENTS

| | | | |
|---|---|---|---|
| 2,977,500 | 3/1961 | Boeker | 250/396 R |
| 3,066,238 | 11/1962 | Arndt | 250/396 R |
| 3,109,931 | 11/1963 | Knowlton et al. | 250/400 |

FOREIGN PATENT DOCUMENTS

| | | |
|---|---|---|
| 1251686 | of 0000 | France . |
| II-0198 | of 0000 | U.S.S.R. . |

*Primary Examiner*—Bruce C. Anderson

*Attorney, Agent, or Firm*—Fleit, Jacobson & Cohn

[57] ABSTRACT

A device for scanning a beam of charged particles comprises longitudinal and cross-sectional scanning electromagnets (1,4) to deflect the beam, respectively, lengthwise and crosswise over the exit window (2), longitudinal and cross-sectional scanning current generators (5, 6) to energize the respective electromagnets (1, 4), and a variable delayer (7) connected between the longitudinal scanning current generator (5) and the synchronizing input of the cross-sectional scanning current generator (6) so that pulses arrive at the input of the variable delayer (7) at the moments when current in the windings of the electromagnet (1) reaches its peak. The variable delayer (7) provides N delay times different from each other by a value of Δ t and set in succession as the pulses arrive at its input, the values N and Δ t being determined from the following relationships:

$$\Delta t \leq d/2f_1L; \quad N \geq 1/f_2\Delta t$$

where d—diameter of the charged particle beam, $f_1$—frequency of the longitudinal scanning, $f_2$—frequency of the cross-sectional scanning, L—value of maximum deflection of the beam along the length of the exit window.

5 Claims, 11 Drawing Figures

DEVICE FOR SCANNING A BEAM OF CHARGED PARTICLES

FIELD OF THE INVENTION

The present invention relates to the accelerator technology, and more particularly to devices for scanning a beam of charged particles.

DESCRIPTION OF THE PRIOR ART

Unlike accelerators intended for scientific investigations, industrial accelerators used, for example, for radiation treating of materials must provide irradiation fields of a considerable extent equal at least to the width of the material to be irradiated. Treating the entire surface of the material is accomplished by transferring the material lengthwise through the field of irradiation.

Forming extended fields of irradiation by forming a beam of an appropriate cross-section immediately in the accelerating structure of an accelerator presents considerable difficulties and has practically passed out of existence by now. There is a wide use of the method for forming extended fields of irradiation based on scanning a beam of charged particles, i.e. displacing a beam of a small cross-section over the surface to be irradiated by deflecting it by a time modulated field, such as magnetic field, for example.

There is known a device for scanning a beam of charged particles (Cf., for example, an article by Akulov V. V. et al. "Promyshlennye uskoriteli serii "Electron" dlja radiatsionnoi himii", NIIEFA pre-print No. II -0198, Leningrad, 1974, p. II), comprising a scanning electromagnet and a scanning current generator to energize this electromagnet. The field generated by current flowing through the windings of the electromagnet provides periodical deflection of the beam of charged particles along the exit window of the vacuum chamber, through which the charged particles are rejected into the atmosphere.

Two criteria are considered to adopt the minimal frequency of the scanning current. Firstly, the beam paths on the material to be irradiated must overlap, upon motion of the latter, or at least contact each other, otherwise different points of the material to be irradiated would obtain dissimilar doze of irradiation. From this it follows, that the higher the speed of motion of the material to be irradiated and the lesser the diameter of the beam, the greater the frequency of its scanning.

Secondly, upon passing of the charged particles through the foil of the exit window, a portion of their energy is lost and is transformed into heat which heats the foil. When the beam passes over the foil, the local temperature of the foil in the site where the beam passes through it exceeds the average temperature of the foil so greater, the lesser the speed of displacement of the beam over the foil is. Local overheating of the foil is dangerous considering both the possibility of its melting and the everlasting heat deformations of the foil resulting in its rupture even at temperatures much below its melting point. Therefore, to prevent the foil from local overheating the frequency of scanning must be as high as possible.

With a frequency of scanning high enough, when there is practically no local overheating, the steady-state temperature of the foil will depend on the ratio of the charged particle beam current to the foil area over which the beam is scattered.

The beam path on the exit window, when using the device described, represents a narrow band having a width equal to the beam diameter and a length determined by the size of the objects to be irradiated. This being so, inasmuch as the current density on the beam axis is much more higher than that on its circumference, it is the mid-width portion of the foil having the most difficult heat removal that carries the major heat load. Uneven distribution of heat load over the foil can result in overheating of some spots of the foil and its malfunction.

Moreover, with increasing beam current density the heat load upon the foil increases and, in order to decrease it, one needs to enlarge the area of the exit window over which the beam is scattered. In the above device, however, because of the beam being deflected in one direction only, the operating area of the foil, i.e. the area over which the beam passes, is rather small and, therefore, a decrease in service life of the foil of the outlet window is bound to occur when using such a device for scanning a beam having a current density high enough.

Known in the prior art is a device for scanning a beam of charged particles as described in French Pat. No. 1,251,686, patented 1970. This device comprises a longitudinal scanning electromagnet and a cross-sectional scanning electromagnet arranged each outside a vacuum chamber coupled with an accelerator of charged particles, and generators of current for longitudinal and cross-sectional scanning, connected to the windings of the respective electromagnets. The longitudinal scanning electromagnet generates a field to deflect the beam along the length of the exit window of the vacuum chamber, whereas the cross-sectional scanning electromagnet generates a field to deflect the beam along the width of the exit window.

With the beam influenced by the two deflecting fields directed perpendicular to each other, the surface of the foil irradiated by the beam can be of the form of a solid band having a length approximately equal to the length of the exit window, and a width exceeding notably the beam diameter, i.e. the surface can be enlarged to a great extent. Therefore, the prior art device can be used for scanning a charged particle beam having a current density greater than that of the device described above. It will be understood, that in order to obtain the beam path on the exit window in the form of a solid band it is necessary to have such a relation of frequencies of the longitudinal and cross-sectional scannings upo which the beam path for each half-period of the cross-sectional scanning will contact or even overlap partially the beam path of the previous half-period of the cross-sectional scanning, i.e. the following relationship should be met:

$$f_2/f_1 \geqq L/d$$

where $f_1$ is frequency of the longitudinal scanning, $f_2$ is frequency of the cross-sectional scanning, L is amount of maximal deflection of the beam along the exit window (the length of the longitudinal scanning), d is diameter of the beam of the charged particles.

It follows therefore, that the lesser the beam diameter and the greater the required amount of deflection of the beam along the exit window, the greater the ratio $f_2/f_1$ should be.

To increase the efficiency of the installation for radiation-chemical treatment of materials it is required to increase the beam current density and the speed of movement of the material to be irradiated, therefore, the frequency of the longitudinal scanning must be increased (to ensure an even irradiation of the material and to decrease local overheating of the foil) and, accordingly, the frequency of the cross-sectional scanning. In doing this, in order to meet the requirements of contacting of the portions of the beam path for two subsequent half-periods of the cross-sectional scanning, the frequency of the latter can be found so high that, because of the raise in the eddy currents brought about in the walls of the vacuum chamber, the nature of change of the cross-sectional deflecting field with time will be distorted. This renders the translation of the beam over the foil non-linear and, therefore, causes an uneven heating of the foil resulting in local overheating.

Moreover, the increase in frequency of the cross-sectional scanning results in heating of the walls of the vacuum chamber with eddy currents and in extra consumption of power from the cross-sectional scanning current generator, which would require a more powerful generator. On the other hand, use in the vacuum chamber of special parts made of an insulating material, such as glass or porcelain, would reduce the reliability of the construction and make it more complex, and is not used in practice.

Again, with the frequency of the cross-sectional scanning maintained at the level where loss due to eddy currents in the walls of the chamber doesn't exceed the allowable value, then with decreasing beam diameter and, at the same time, with increasing of the exit window length and enhancing frequency of the cross-sectional scanning, the beam path on the foil for each half-period of the cross-sectional scanning would fail to contact its path for the previous half-period of the cross-sectional scanning, resulting in that the portion of the foil irradiated by the beam would represent not a solid band but a broken line having a width equal to the beam diameter and corresponding, in its form, to the current change in the windings of the cross-section scanning electromagnet. Therefore, in this case too, the foil of the exit window will be heated unevenly resulting in reducing service life.

SUMMARY OF THE INVENTION

The principal object of the present invention is to provide a device for scanning a beam of charged particles, wherein the cross-sectional scanning current generator should operate so as to ensure an even distribution of heat load over the foil of the exit window of the vacuum chamber without the frequency of the cross-sectional scanning being increased.

With this principal object in view, there is provided a device for scanning a beam of charged particles over the surface of the exit window of a vacuum chamber coupled with a charged particle accelerator, comprising longitudinal and cross-sectional scanning electromagnets to deflect the beam of charged particles along the length and width of the exit window, respectively, and longitudinal and cross-sectional scanning current generators to energize the respective electromagnets, wherein, according to the invention, said device further comprises a variable delayer whose output is connected with the synchronizing input of the cross-sectional scanning current generator, and whose input is connected with the longitudinal scanning current generator so that pulses arrive at the variable delayer input at the moments when the current in the windings of the longitudinal scanning electromagnet reaches its peak, which variable delayer provides N delay times different from each other by a $\Delta t$ value and set in succession as the pulses arrive at its input, the values N and $\Delta t$ being determined from the following relationships:

$$\Delta t \leqq 1/2f_1L; \quad N \geqq 1/f_2\Delta t$$

where d—diameter of the charged particle beam, $f_1$—frequency of the longitudinal scanning, $f_2$—frequency of the cross-sectional scanning, L—value of maximum deflection of the beam along the length of the exit window.

The variable delayer connected between the longitudinal scanning current generator and the synchronizing input of the cross-sectional scanning current generator provides periodically varying time shift of pulses synchronizing the cross-sectional scanning current generator with respect to the moments of the beginning of the longitudinal scanning in each its half-period. This provides a shift of the charged particle beam paths over the surface of the exit window of the vacuum chamber. By doing so, said number of the delay times set by the variable delayer, as well as said value of the difference in these delay times ensure such a shift of the beam paths at which upon elapsing the time equal to the longitudinal scanning half-period duration multiplied by said number of the delay times, these paths will contact close to each other or overlap partially each other.

Therefore, during an interval of time long enough as compared with the duration of the longitudinal scanning period, all the portions of the foil of the exit window will practically be subjected to the same action of the charged particles, and the heat load upon the foil will be distributed evenly over its surface. This results in an increased reliability of the foil and the vacuum chamber as a whole.

In case if the driver stage of the longitudinal scanning current generator forms clock pulses having a frequency equal to a doubled frequency of the longitudinal scanning, then the input of the variable delayer can be connected to the output of the driver stage of the longitudinal scanning current generator.

Such a connection of the variable delayer with the longitudinal scanning current generator proves to be most simple since no additional components are required.

The device for scanning a beam of charged particles may comprise a shaper of clock pulses connected between the output of the longitudinal scanning current generator and the input of the variable delayer to shape the clock pulses at the moments the current in the windings of the longitudinal scanning electromagnet reaches its peak.

Connecting the shaper of clock pulses between the output of the longitudinal scanning current generator and the input of the variable delayer is necessary in cases where the driver stage of the longitudinal scanning generator shapes a signal with a frequency equal to the frequency of the longitudinal scanning, for example, where a multivibrator is used for the driver stage of the longitudinal scanning current generator.

According to one of the embodiments of the present invention, the variable delayer comprises a pulse counter whose counting input is the input of the variable delayer, a decoder connected to the outputs of the pulse counter, and fixed delay components connected between the outputs of the decoder and the output of the variable delayer.

According to another embodiment of the invention, the variable delayer comprises a pulse counter whose counting input is the input of the variable delayer, a decoder connected to the outputs of the pulse counter, an integrator whose input is connected through an OR gate with the outputs of the decoder, and a comparator, whose input is connected with the integrator output and whose output is the output of the variable delayer, the outputs of the decoder being connected with Zener diodes different from each other by stabilizing voltage value.

The present invention will better be understood from a consideration of the following detailed description of the preferred embodiments when used in connection with the accompanying drawings, wherein:

BEST MODE TO CARRY OUT THE INVENTION

Figure 1:
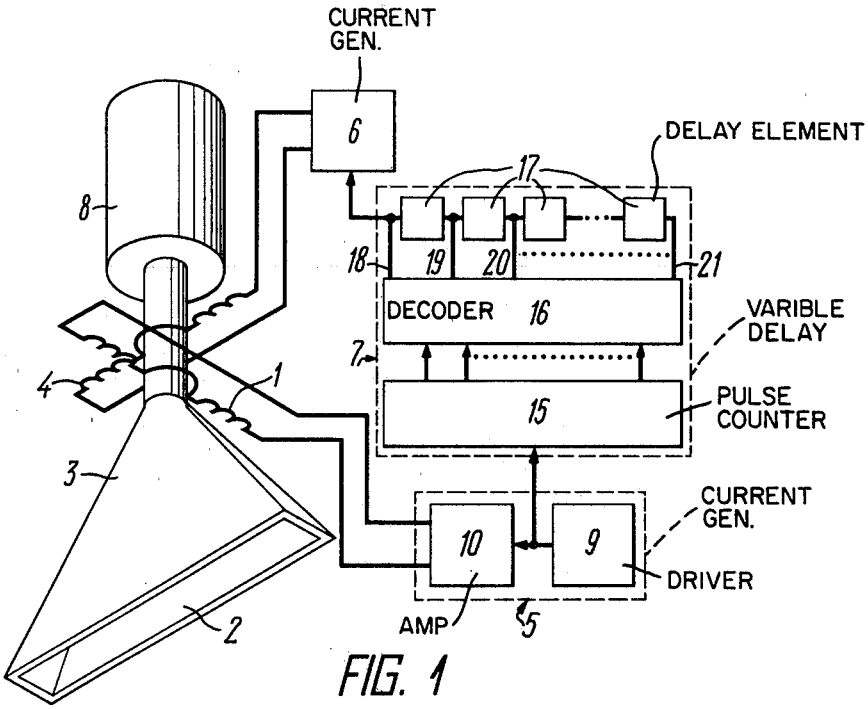
FIG. 1 is a schematic view of a device for scanning a beam of charged particles, according to the invention.

Referring to FIG. 1, the device for scanning a beam of charged particles, according to the invention, comprises a longitudinal scanning electromagnet 1 to deflect the beam of charged particles along the length of an exit window 2 of a vacuum chamber 3, an electromagnet 4 to deflect the beam of charged particles along the width of the exit window 2 of the vacuum chamber 3, a longitudinal scanning current generator 5, a cross-sectional scanning current generator 6, and a variable delayer 7.

The longitudinal scanning electromagnet 1 and the cross-sectional scanning electromagnet 4 are arranged on the neck of the vacuum chamber 3 shaped as a metallic bell expanding toward the exit window 2 and whose narrowed portion is joined to the outlet opening of the acceleration tube of a charged particle accelerator 8. The exit window 2 of the vacuum chamber 3, through which the beam of charged particles formed by the accelerator 8 escapes in the air, is made of a thin metallic foil, for example, titanium or aluminium foil permeable for charged particles.

The generators 5 and 6 comprise each a drive stage and an output balanced stage, only a driver stage 9 and output stage 10 of the longitudinal scanning current generator 5 being shown in FIG. 1.

The output of the cross-sectional scanning current generator 6 is connected to the windings of the cross-sectional scanning electromagnet 4. The output of the longitudinal scanning current generator 5 is connected to the windings of the longitudinal scanning electromagnet 1. The longitudinal scanning current generator 5 is also connected with the input of the variable delayer 7 so that pulses arrive at the input of the variable delayer 7 of the moments when the current in the windings of the longitudinal scanning electromagnet 1 reaches its peak. The output of the variable delayer 7 is connected with the synchronizing input of the cross-sectional scanning current generator 6.

According to one of the embodiments, the input of the variable delayer 7 is connected with the output of the driver stage 9 of the longitudinal scanning current generator 5, the driving stage 9 therewith shapes pulses with a frequency equal to a doubled frequency of the longitudinal scanning current.

Figure 2:
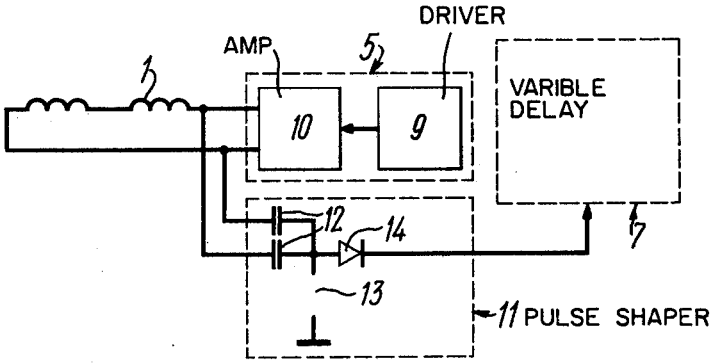
FIG. 2 is another version of coupling of the variable delayer with the cross-sectional scanning current generator, shown in FIG. 1.

Referring to FIG. 2, there is shown another embodiment of the invention, wherein a clock pulse shaper 11 is connected between the output of the longitudinal scanning current generator 5 and the input of the variable delayer 7, to shape clock pulses at the moments when the current in the windings of the longitudinal scanning electromagnet 1 reaches its peak. The clock pulse shaper 11 comprises, for example, a differentiating circuit, formed by capacitors 12 connected to the outputs of the output balanced stage 10 of the generator 5, and a resistor 13, and separation diodes 14. It is advantageous to use such an embodiment where the frequency of pulses of the driver stage 9 of the longitudinal scanning current generator 5 is equal to the frequency of the longitudinal scanning, for example, in case where a multivibrator is used for the driver stage 9 of the generator 5.

The variable delayer 7 is intended to delay signals arriving at the synchronizing input of the cross-sectional scanning current generator 6 (FIG. 1) with respect to the moments when the current in the windings of the longitudinal scanning electromagnet 1 reaches its peak, i.e. with respect to the moments when the longitudinal scanning begins. The delay time therewith varies automatically as the next pulse in turn arrives at the input of the variable delayer 7 so that the paths of the charged particles beam over the exit window 2 will, in a period time, contact close to each other or overlap partially each other. It is evident that in order this be so, it is necessary that the delay time provided by the variable delayer 7 be varied discretely by such a $\Delta t$ time during which the beam of charged particles will pass a distance equal to its diameter of less. Therefore, the delay time variation step $\Delta t$ is determined from the relationship:

$$\Delta t \leqq d/2f_1L$$

where d—diameter of the charged particle beam, $f_1$—frequency of the longitudinal scanning, L—maximal deflection of the beam along the exit window, i.e. the length of the longitudinal scanning.

It will therewith be sufficient, that the delay time varies within the period of the cross-sectional scanning, therefore, the required number N of the delay steps, i.e. the delay time number provided by the variable delayer 7 can be obtained from the relationship $$N \geqq 1/f_2\Delta t$$

where $f_2$-frequency of the cross-sectional scanning.

Assume, for example, that the length of the longitudinal scanning is 2000 mm, the beam diameter is 3 mm, the longitudinal scanning frequency is 100 Hz, and the cross-sectional scanning frequency is 5000 Hz. Then $\Delta t \leqq 7.5$ mcsec. and $N \geqq 26.6$, i.e. it can be adopted that $N=27$.

Thus, the delay time varies at a step $\Delta t$ in the range from 0 to $(N-1)\ \Delta t$ as N signals arrive in succession at the input of the variable delayer 7. For example, upon arrival of the first signal from this succession, a time delay equal to zero is set, upon arrival of the second signal a delay time equal to $\Delta t$ is set, upon arrival of the third signal, $2\ \Delta t$, and upon arrival of the last one, $(N-1)\ \Delta t$. The next succession of N signals will have the same variation in the time delay.

The minimum delay time may not be zero, but may correspond to a value of $t_o$, then the delay time will vary in the range from $t_o$ to $t_o+(N-1)\ \Delta t$ at a step of $\Delta t$. However, this minimum delay time $t_o$ should be chosen small enough so that the transition of the beam from one path to another should occur on the extreme portions of the exit window 2 along its length.

It should be noted that the variation in the shift of a signal at the input of the cross-sectional scanning current generator 6 as compared with the shift of the precedent signal by the value $\Delta t$ is not a necessary requirement to ensure the contact of the paths of the beam on the exit window 2. In effect, as signals arrive in succession at the input of the variable delayer 7, the delay time can vary in any arbitrary succession, not only increase or decrease monotonically, provided that the delay time of each signal picked out from any successive N signals differ from the delay time of any signal picked out from the remainder of this succession. Stated another way, the delay time of a signal picked out from N successive signals is equal to $K\ \Delta t$ (or $t_o+K\ \Delta t$), where K is a whole number from zero to $(N-1)$, an appropriate value K therewith corresponds to each signal in this succession, this value being different from the values K for the signals from the remainder of this succession.

According to one of the embodiments, the variable delayer 7 comprises a pulse counter 15, a decoder 16, and fixed delay components 17 connected between the outputs of the decoder 16 and the output of the variable delayer 7.

The counting input of the pulse counter 15 is the input of the variable delayer 7. A number of bit positions of the counter 15 is chosen such as to provide its capacitance i.e. the maximum number of counted pulses be not less than the required number N of delay steps provided by the variable delayer 7. In particular, in the above numerical example with the use of a binary counter, the latter can have five bit positions.

The inputs of the decoder 16 are connected with the outputs of the pulse counter 15. The number of the outputs of the decoder 16 is also equal to the quantity n of the delay steps provided by the delayer 7, only four of the outputs of the decoder 16 being shown in FIG. 1, designated with reference numerals 18, 19, 20, and 21.

The number of the fixed delay components 17 is equal to the number of the outputs of the decoder 16. The fixed delay components 17 can be connected to each other in parallel as shown in FIG. 1, in which case each of these would provide a delay time equal to $\Delta t$, and a delay component would be connected between each two outputs of the decoder 16, whereas a different number of these would be connected between the outputs of the decoder 16 and the output of the variable delayer 7, namely, the output 18 of the decoder 16 is connected immediately with the output of the variable delayer 7, the output 19, through one fixed delay component 17, the output 20, through two fixed delay components 17 and so on, while the output 21, through all the fixed delay components 17 available.

It is evident, that the number of the fixed delay components 17 may be equal to the number of the outputs of the decoder 16 if there is required a delay of all the signals arriving to synchronize the longitudinal scanning current generator 5. In this case, a delay component should be connected between the output of the variable delayer 7 and the synchronizing input of the cross-sectional scanning current generator 6 to provide the minimum delay time $t_o$ required.

Figure 3:
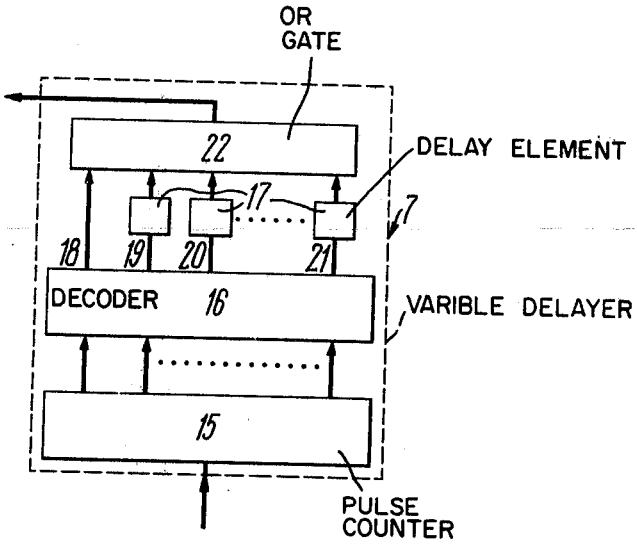
FIG. 3 is another version of connection of the components of the variable delayer shown in FIG. 1, according to the invention.

Referring to FIG. 3, there is shown another version for connection of the fixed delay components 17 with the outputs of the decoder 16. Here, the components 17 provide different delay times which are $\Delta t$-fold, i.e. 0, $\Delta t$, $2\ \Delta t$ . . . $(N-1)\ \Delta t$, one delay component 17 being connected to each output of the decoder 16 (except for its output 18). The delay components 17 and the output 18 of the decoder 16 are connected through a multiple input OR gate 22 with the output of the variable delayer 7.

Other versions of interconnection of the components of the variable delayer 7 are possible, for example, fixed delay components can be connected between flip-flops constituting the bit positions of the pulse counter, the outputs of the decoder being therewith connected with the synchronizing input of the cross-sectional scanning current generator 6 through an OR gate.

Figure 4:
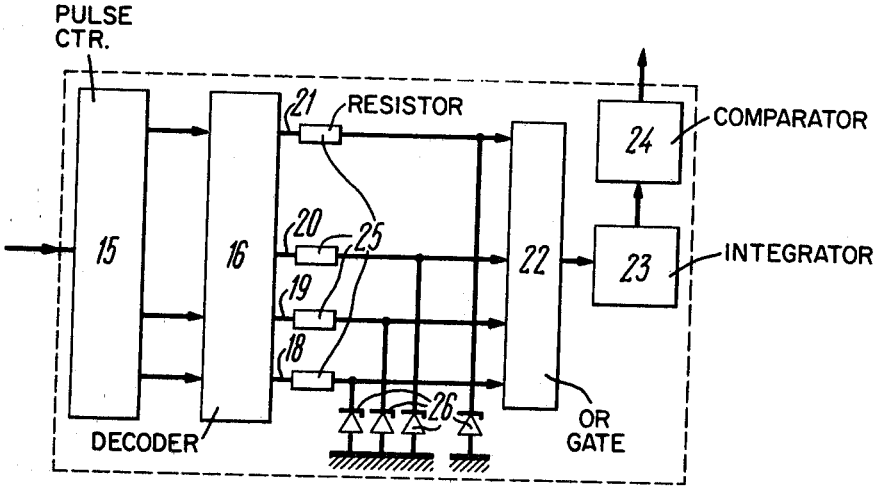
FIG. 4 is another embodiment of the variable delayer shown in FIG. 1.

Referring to FIG. 4, there is shown another version of the variable delayer 7, wherein, apart from the pulse counter 15, decoder 16, and OR gate 22, it comprises an integrator 23 and a comparator 24. The outputs of the decoder 16 are connected through limit resistors 25 and the OR gate 22 with the input of the integrator 23 built, for example, on the base of an operational amplifier, the outputs of the decoder 16 each is therewith connected to one of Zener diodes 26 having different stabilizing voltages. The output of the integrator 23 is connected with the input of the comparator 24 providing pulses each moment the voltage at its input reaches its reference value. The output of the comparator 24 is the output of the variable delayer 7.

The proposed device operates as follows.

Figure 5:
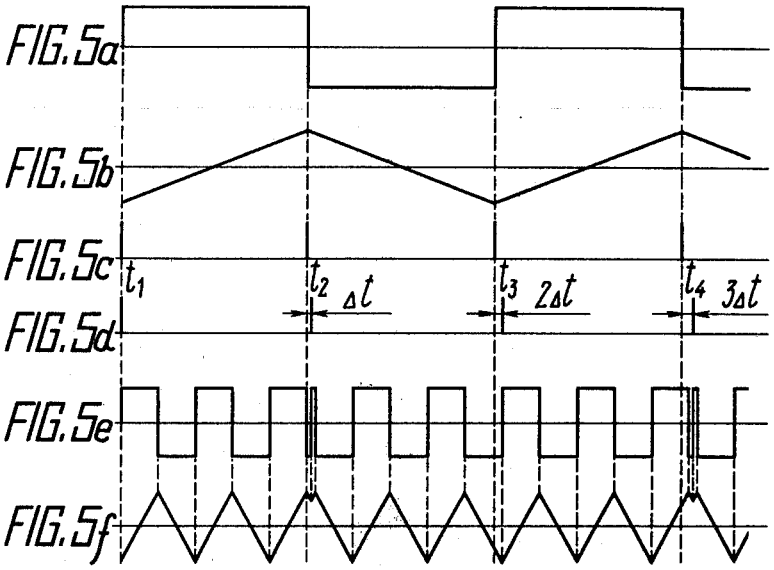
FIGS. 5*a* through 5*f* are time plots illustrative of operation of the device shown in FIG. 1.

The windings of the longitudinal scanning electromagnet 1 (FIG. 1) are energized with a voltage from the output of the longitudinal scanning current generator 5 (FIG. 1), having a shape of rectangular pulses shown in FIG. 5*a*, whereby a current in the form of symmetrical triangular pulses shown in FIG. 5*b* begins to flow through these windings. At the same time, clock pulses arrive at the input of the counter 15 (FIG. 1) from the driver stage 9 of the longitudinal scanning current generator 5 or from the clock pulse shaper 11 (FIG. 2). These pulses appear, as will be seen in FIG. 5*c*, each time the current in the windings of the longitudinal scanning electromagnet 1 (FIG. 1) reaches its peack, i.e. where the charged particle beam is found in the extreme positions along the length of the exit window 2.

The counter 15 counts N clock pulses arriving in succession, is set to zero by the $(N+1)$ clock pulse, and begins to count the next succession of N clock pulses anew. A signal at a specific output of the decoder 16 therewith corresponds to each value of the counter contents.

Assume that the contents of the counter 15 is zero at the first half-period of the longitudinal scanning under consideration and the decoder 16 shapes a signal (see FIG. 5*d*), for example, at its output 18. This signal arrives at the synchronizing input of the cross-sectional scanning current generator 6 with no delay with respect to the output pulse of the driver stage (not shown) of the cross-sectional scanning current generator 6, i.e. at the moment $t_1$ (FIG. 5*c*) corresponding to a peak value of current in the windings of the cross-sectional scanning electromagnet 4 (FIG. 1). Voltage at the output of the cross-sectional scanning current generator 6 and current in the windings of the cross-sectional scanning electromagnet 4 are shown in FIGS. 5*e* and 5*f*, respectively. Thus, at the moment $t_1$ (FIG. 5*c*) the charged particle beam is found in the extreme position both along the length and width of the exit window 2 shown in plan in FIG. 6, for example at its left-lower corner.

Upon action of variable deflecting fields generated by the electromagnets 1 (FIG. 1) and 4, the beam moves from the left to the right at a constant speed along a path 27 (FIG. 6) constituting a broken line.

Upon completion of the first half-period of the longitudinal scanning (the moment $t_2$ in FIG. 5*c*), the next clock pulse is shaped and the contents of the counter 15 (FIG. 1) becomes equal to one. A signal of the decoder 16 is therewith formed at its output 19, for example. The signal of the decoder 16 arrives at the synchronizing input of the cross-sectional scanning current generator 6 through one fixed delay component 17, i.e. with a delay by $\Delta t$ time with respect to the clock pulse at the input of the counter 15, as shown in FIG. 5*d*, so that the voltage at the output of the cross-sectional scanning current generator 6 becomes of opposite sign at the moment $(t_2+\Delta t)$ (see FIG. 5*e*), the current in the windings of the cross-sectional scanning electromagnet 4 therewith starts to vary in other direction, as shown in FIG. 5*f*, i.e. the sign of its first derivative becomes opposite.

Figure 6:
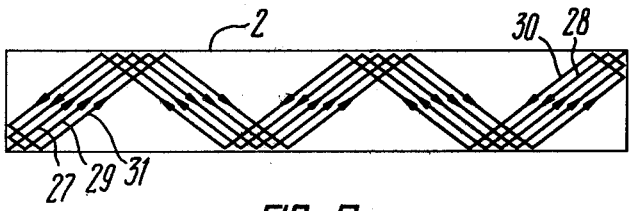
FIG. 6 represents paths of the charged particle beam over the exit window of the vacuum chamber, formed during operation of the device shown in FIG. 1.

As a result of the change in sign of the derivative of the cross-sectional scanning current, the charged particle beam which had been moving during the period from the moment $t_2$ to the moment $(t_2+\Delta t)$ along the path 27 (FIG. 6) but in reverse direction, i.e. from the right to the left, now is shifted from this path downward (with respect to FIG. 6) and begins to move along an other path indicated with reference numeral 28 in FIG. 6.

At the moment $t_3$ (FIG. 5*c*), the third clock pulse arrives at the input of the counter 15 (FIG. 1). A signal of the decoder 16 corresponding to the counter contents equal to two appears, for example, at the output 20 and arrives to the synchronizing input of the cross-sectional scanning current generator 6 through two fixed delay components 17, i.e. at a delay by 2 $\Delta t$ time with respect to the corresponding clock pulse at the input of the counter 15, as shown in FIG. 5*d*. Upon action of this signal, the voltage at the output of the cross-sectional scanning current generator 6 (FIG. 1) reverses its polarity and, accordingly, the derivative of the current of the cross-sectional scanning reverses its sign, as it can be seen in FIGS. 5*e* and 5*f*, while the beam passes from the path 28 (FIG. 6) to a new path 29.

Upon arrival of the next clock pulses at the input of the variable delayer 7 (FIG. 1), the delay time is varied stepwise by varying the number of the fixed delay components 17 connected between the decoder 16 and the synchronizing input of the cross-sectional scanning current generator 6. As a result of this, a similar shift of the paths of the beam over the exit window 2 occurs.

To make the illustration in FIG. 6 more descriptive, only a number and not all the paths of the beam occurring during N successive half-periods of the longitudinal scanning are shown. Furthermore, the beam paths are depicted with thin lines, despite the fact that each of the paths has a definite thickness equal to the beam diameter.

Finally, upon arrival of the N-th clock pulse, a signal corresponding to the maximum contents of the counter 15 (FIG. 1) is formed, for example, at the output 21 of the decoder 16 and then it is fed to the synchronizing input of the cross-sectional scanning current generator 6 through all the parallel-connected fixed delay components 17, whereby the path of the beam over the exit window 2 is displaced to "free" areas vacant of its paths during the precedent half-periods of the longitudinal scanning.

Upon arrival of the $(N+1)$-th clock pulse, the counter 15 is set to zero and the beam will anew move along the path 27 (FIG. 6). The above cycle is then repeated.

Thus, upon arrival of the clock pulses at the input of the variable delayer 7 (FIG. 1), 0,1,2, . . . $(N-1)$ fixed delay components 17 are connected in succession between the input and output of this delayer, thereby varying the delay time by $\Delta t$ step. (As mentioned above, the delay components 17 can be connected in some other succession determined by the connection of the outputs of the decoder 16 thereto). Due to the shift of the point of synchronization of the cross-sectional scanning current generator 6 with respect to the moment the longitudinal scanning begins in each its half-period, the paths of the beam on the exit window 2 are shifted and, upon elapsing N half-periods of the longitudinal scanning, the paths of the beam on the exit window 2 will contact each other forming a solid wide band over the window 2. Thus, all the areas of the surface of the exit window 2 will be under the same heat load.

The variable delayer 7 shown in FIG. 3 operates in an analogous way, except that one delay component 17 at a time is connected in succession between the input and output of the delayer 7 upon arrival of the next clock pulse. By virtue of the fact that, in this version, each of the fixed delay components 17 has a $\Delta t$-fold delay time which is different from the delay time of the other components 17, the paths of the beam on the exit window will be shifted in the same manner as described above.

In the embodiment of the variable delayer 7 shown in FIG. 4, the delay of the output signals of the variable delayer 7 with respect to its input signals is attained at the expense of the time during which the voltage at the output of the integrator 23 reaches the reference voltage of the comparator 24, and the change in the delay time is attained through connection of the Zener diodes 26 to the outputs of the decoder 16. As mentioned above, the Zener diodes 26 have different stabilization voltages, so that the signals at the outputs of the decoder 16 have different levels. As a result of this, the voltage at the output of the integrator 23 will, at each of N successive half-periods of the longitudinal scanning, rise at a different rate and, therefore, the point of operation of the comparator 24 will be shifted, relative to the moments $t_1$, $t_2$, and $t_3$ (FIG. 5) when the longitudinal scanning begins, by a different value. By selection of the Zener diodes 26 (FIG. 4) having appropriate stabilization voltages, it can be obtained that said shift of the point of operation of the comparator 24 be changed from one half-period of the longitudinal scanning to another by the Δt value.

COMMERCIAL APPLICABILITY

The present invention can find wide use in various commercial installations intended for irradiation of objects by charged particles, for instance, in commercial accelerators to be used for treating materials by radiation. The invention provides for a prolonged service life of the foil of the exit window of the vacuum chamber and, therefore, cuts the operating costs owing to a reduced idle time of the radiation-chemical installations, required for replacement of the foil and evacuation of the vacuum volume.

We claim:

1. A device for scanning a beam of charged particles over the surface of an exit window of a vacuum chamber coupled with a charged particle accelerator, comprising longitudinal and cross-sectional scanning electromagnets to deflect the beam of charged particles along the length and width of the exit window, respectively, and longitudinal and cross-sectional scanning current generators to energize the respective electromagnets, characterized in that the device further comprises a variable delayer (7) whose output is connected with the synchronizing input of the cross-sectional scanning current generator (6) and whose input is connected with the longitudinal scanning current generator (5), so that pulses arrive at the input of the variable delayer (7) at the moments when the current in the windings of the longitudinal scanning electromagnet (1) reaches its peak, which variable delayer provides N delay times different from each other by a Δt value and set in succession as the pulses arrive at its input, the values N and Δt being determined from the following relationships:

$$\Delta t \leqq d/2f_1L; \quad N \geqq 1/f_2\Delta t$$

where d—diameter of the charged particle beam, $f_1$—frequency of the longitudinal scanning, $f_2$—frequency of the cross-sectional scanning, L—value of maximum deflection of the beam along the length of the exit window.

2. A device according to claim 1, characterized in that the input of the variable delayer (7) is connected to the output of a driver stage (9) of the longitudinal scanning current generator (5).

3. A device according to claim 1, characterized in that it comprises a clock pulse shaper (11) connected between the output of the longitudinal scanning current generator (5) and the input of the variable delayer (7) to shape clock pulses at the moments when the current in the windings of the longitudinal scanning electromagnet reaches its peak.

4. A device according to any one of claims 1 through 3, characterized in that the variable delayer (7) comprises a pulse counter (15) whose counting input is the input of the variable delayer (7), a decoder (16) connected to the outputs of the pulse counter (15), and fixed delay components (17) connected between the outputs of the decoder (16) and the output of the variable delayer (7).

5. A device according to any one of claims 1 through 3, characterized in that the variable delayer (7) comprises a pulse counter (15) whose counting input is the input of the variable delayer (7), a decoder (16) connected to the outputs of the pulse counter (15), an integrator (23) whose input is connected through an OR gate (22) with the outputs of the decoder (16), and a comparator (24) whose input is connected with the output of the integrator (23) and whose output is the output of the variable delayer (7), Zener diodes (26) different from each other by stabilization voltage value being connected to the outputs of the decoder (16).

* * * * *